US006334760B1

(12) United States Patent
Walker

(10) Patent No.: US 6,334,760 B1
(45) Date of Patent: Jan. 1, 2002

(54) PUMP AND FILTER ASSEMBLY FOR LOW VISCOSITY FLUIDS

(76) Inventor: James Walker, 784 Shively Creek Rd., Days Creek, OR (US) 97429

( * ) Notice: Subject to any disclaimer, the term of this patent is extended or adjusted under 35 U.S.C. 154(b) by 0 days.

(21) Appl. No.: 09/541,212

(22) Filed: Apr. 3, 2000

(51) Int. Cl.[7] ..... F04B 53/00; F04B 23/00; F04B 39/00

(52) U.S. Cl. ..... 417/313; 417/554

(58) Field of Search ..... 417/313, 554, 417/323, 503, 571, 454, 440, 464, 63, 252; 96/189; 222/189.1

(56) References Cited

U.S. PATENT DOCUMENTS

| | | | | | |
|---|---|---|---|---|---|
| 2,338,419 | A | | 1/1944 | Forrest et al. | |
| 2,787,222 | A | | 4/1957 | Thomas | |
| 2,883,939 | A | | 4/1959 | Russell | |
| 3,583,837 | A | * | 6/1971 | Rolsten | 417/554 |
| 3,749,524 | A | * | 7/1973 | Jordan | 417/323 |
| 3,883,275 | A | * | 5/1975 | Browne | 417/503 |
| 3,904,326 | A | * | 9/1975 | Clement | 417/571 |
| 4,260,341 | A | * | 4/1981 | Rolsten | 417/454 |
| 4,565,506 | A | * | 1/1986 | Williams | 417/440 |
| 4,961,694 | A | * | 10/1990 | Gardetto | 417/464 |
| 5,066,468 | A | | 11/1991 | Arnold et al. | |
| 5,154,821 | A | | 10/1992 | Reid | |
| 5,575,627 | A | * | 11/1996 | Vairin et al. | 417/252 |
| 5,713,723 | A | * | 2/1998 | Hathaway | 417/63 |
| 5,718,744 | A | * | 2/1998 | Elhert | 96/189 |
| 6,068,163 | A | * | 5/2000 | Kihm | 222/189.1 |

* cited by examiner

*Primary Examiner*—Teresa Walberg
*Assistant Examiner*—Leonid Fastovsky
(74) *Attorney, Agent, or Firm*—Robert E. Howard

(57) ABSTRACT

A hand operated pump and filter assembly for transferring low viscosity fluids, such as hydraulic oil, from a supply container to a machine requiring the fluid, and for filtering the fluid. The pump is a combination vacuum and displacement pump. The pump has a barrel with a cylindrical central passageway therein. A piston is positioned within the central passageway and is connected to the lower end of a piston rod. The upper end of the piston rod is attached to a handle for effecting upward and downward movement of the piston. The piston has fluid passageways extending therethrough and valve means associated with the fluid passageways to prevent fluid from flowing through the passageways during the piston upstroke but allowing fluid to flow through the passageways during the piston downstroke. The inlet end of the pump barrel has a valve subassembly means which seals communication between the central passageway thereof and a fluid supply container during the piston downstroke but opens communication during the piston upstroke. An adapter is provided for locking the pump barrel to the outlet of a fluid supply container. The outlet end of the pump barrel communicates with a filter via a conduit. The filter is preferably a ten micron filter for removing very fine impurities from the fluid being pumped. The outlet of the filter communicates with the machine to which the fluid is being transferred via a flexible conduit.

27 Claims, 2 Drawing Sheets

PUMP AND FILTER ASSEMBLY FOR LOW VISCOSITY FLUIDS

BACKGROUND OF THE INVENTION

This invention relates to a hand operated pump and filter assembly for transferring and filtering low viscosity fluids, such as hydraulic oils, transmission fluids, some motor oils, etc.

With modern hydraulic machinery the components that pump and control the machine have critical clearances of down to about 0.0003 inch. Contamination of the hydraulic oil causes accelerated wear in the high performance components of such systems.

It is known in the bearing industry that bearing life is extended when the hydraulic oil is properly filtered. Hydraulic component manufacturers will not always honor component warranties if the oil does not meet ISO 4406 specifications.

A number of hydraulic oil transfer pumps have been used, but none have addressed the problem of pushing the oil through a fine (ten micron) filter to keep contamination out of high performance components with clearances of about 0.0003 inch.

SUMMARY OF THE INVENTION

It is an object of this invention to provide a hand operated pump for transferring low viscosity fluids from supply containers to a fluid reception point.

It is a further object of this invention to provide a hand operated pump and filter assembly for transferring low viscosity fluids from supply containers to a fluid reception point.

It is a still further object of this invention to provide a hand operated pump and filter assembly for transferring hydraulic oil from a supply container through a ten micron or less filter to machinery having components which require close tolerances.

These and other objects are achieved by providing a manually operated Dump that acts as a combination vacuum and displacement pump.

The pump of the invention has a barrel with inner and outer cylindrical walls, the inner cylindrical wall forming a central passageway extending between an inlet end and an outlet end.

A cylindrical piston rod is positioned with its inner end being located within the e central passageway of the e barrel and its outer end outside the central passageway of the barrel, the piston rod and barrel having a common longitudinal axis. The outer cylindrical wall of the barrel has a longitudinally extending vent groove machined therein to allow air to enter a fluid supply container as fluid is being pumped out of it.

The outer end of the piston rod is attached to a handle for manually raising and lowering the piston rod during the upstroke and downstroke, respectively.

A piston is attached to the inner end of the piston rod. The piston has at least one fluid passageway extending therethrough, the passageway having an associated valve means for closing the passageway during an upward stroke of the piston rod and opening the passageway during a downward stroke of the piston rod.

The inlet end of the barrel has valve subassembly means for opening communication between the exterior of the barrel and its central passageway during an upstroke and closing communication during a downstroke.

A lock adapter for attaching the pump to a fluid oil supply container is provided. The adapter is slidably attached to the outer cylindrical wall of the pump barrel and is threaded to lockingly engage the threads of the outlet of a supply container.

DESCRIPTION OF PREFERRED EMBODIMENTS

Figure 1:
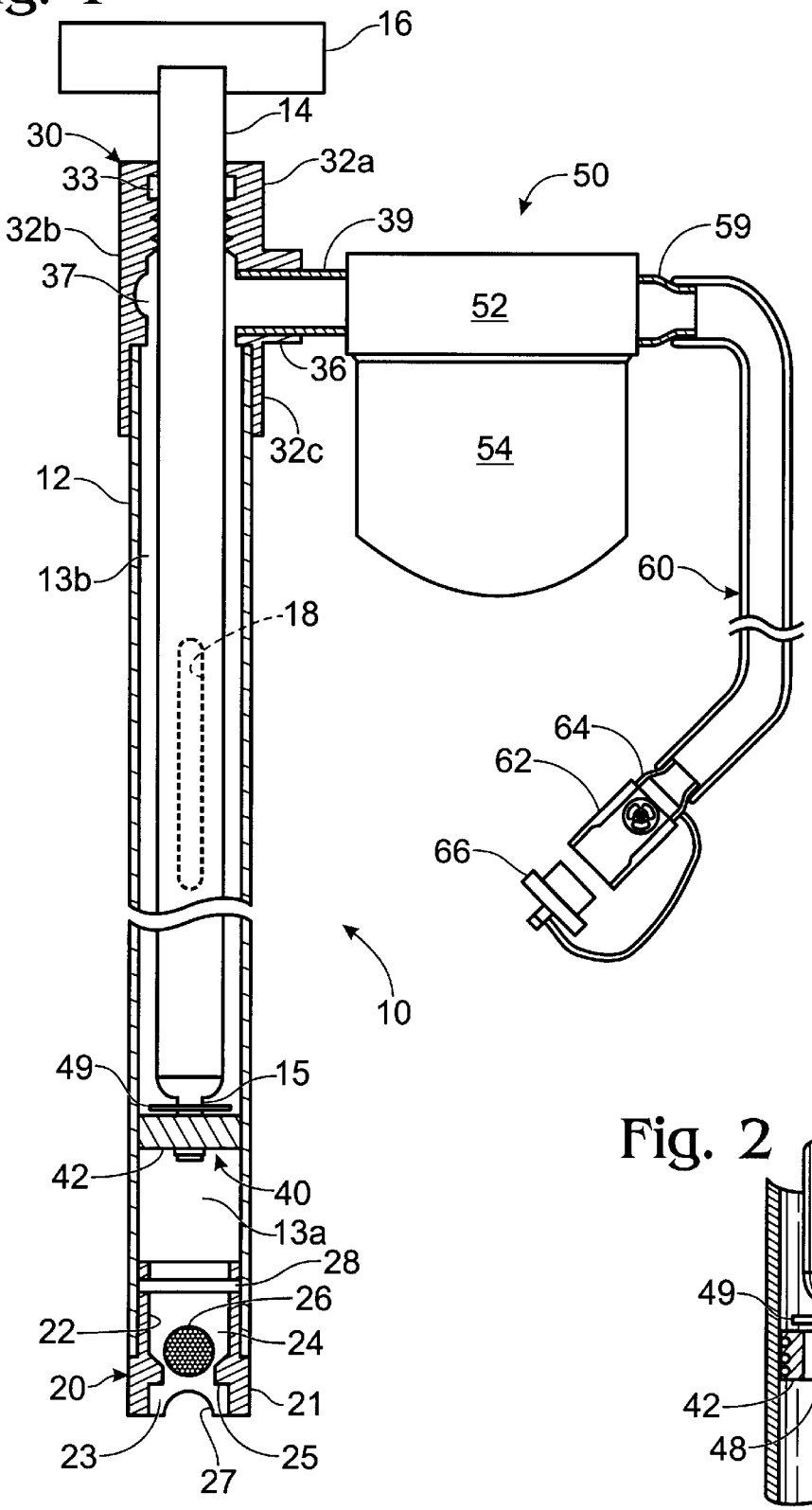
FIG. 1 is a front view, partially in cross-section, of the pump and filter assembly of this invention.

The pump 10 of the invention is comprised of a barrel 12 having inner and outer cylindrical walls, the space within the inner cylindrical wall forming a central passageway 13*a*. A cylindrical piston rod 14 has its inner end located within the central passageway 13*a* of barrel 12 and its outer end located outside the central passageway of barrel 12. An annular oil passageway 13*b* is formed in the space between the inner cylindrical wall of barrel 12 and the outer cylindrical wall of piston rod 14. Barrel 12 and piston rod 14 have a common longitudinal axis.

An oil inlet subassembly 20 having first and second cylindrical body portions 21 and 22 is removably attached to the lower end of barrel 12, such as by press fitting cylindrical body portion 22 against the inner cylindrical wall of the lower end of barrel 12. First and second oil inlet passageways 23 and 24, respectively, are centrally located within first and second cylindrical body portions 21 and 22, respectively. A narrowed passageway formed by annular shoulder 25 communicates first passageway 23 with second passageway 24, with shoulder 25 forming a seat for ball 26 located within second passageway 24. Thus, oil inlet subassembly 20 acts as a check valve during operation.

Several semicircular openings 27, preferably three, are cut out of the first (lower) end of first cylindrical body portion 21 of inlet subassembly 20, only one of which openings 27 is shown in FIG. 1. Semicircular openings 27 permit oil to enter first passageway 23 even if the lower end of oil inlet subassembly 20 is otherwise touching and in sealing contact with the bottom of an oil supply container.

Stop pin 28 prevents ball 26 from entering the lower end of barrel 12.

Outlet subassembly body 30 is generally cylindrical and has an upper body portion 32*a*, a mid-body portion 32*b*, and a lower body portion 32*c*. Upper body portion 32*a* and lower body portion 32*c* each have a central bore running therethrough. Mid-body portion 32*b* has a central fluid receiving cavity 37 therein communicating with the central bore of lower body portion 32*c* for receiving fluid from annular fluid passageway 13*b*.

Outlet subassembly 30 is removably attached to the upper end of barrel 12, preferably by having the diameter of the outer surface of barrel 12 and the inner surface of the central bore of lower body portion 32*c* being close enough to each other to provide a for a press fit therebetween. However, outlet subassembly 30 can be removably attached to the upper end of barrel 12 by other means, such as mating threads located on the outer surface of barrel 12 and on the inner surface of the central bore of lower body portion 32*c*.

An annular seal groove 33 is located at the upper end of the inner surface of the central bore of the upper body portion 32*a*. Seal groove 33 is adapted to receive a ring type seal member (not shown) to prevent oil from leaking between piston rod 14 and the adjacent inner surface of the bore of upper body portion 32*a*.

Two piston rod annular centering grooves 34 are located below annular seal groove 33. Centering grooves 34 fill with oil during use of pump 10, and turbulence caused by pumping acts to center the upper end of piston rod 14, the lower end of piston rod 14 being centered by piston 42. Also, the land area 35 between centering grooves 34 is a bearing surface lubricated by the fluid being transferred by pump 10.

An oil exit port 36 is located in the mid-body portion 32*b* of outlet subassembly 30, as shown. Oil exit port 36 communicates oil receiving cavity 37 with the exterior of the mid-body portion 32*b* of exit subassembly 30.

A threaded inlet fitting or nipple 39 is attached to oil exit port 36, such as by mating threads located on the exterior of nipple 39 and the interior of exit port 36.

Piston rod 14 is formed of solid rod stock and has a first and second end. The first, inner end is located within the central passageway 13*a* of barrel 12 and terminates at a tip 15. Tip 15 has a smaller diameter than the main body portion of piston rod 14. The second, outer end of piston rod 14 is located outside the central passageway 13*a* of barrel 12.

A handle 16 is attached to the outer end of piston rod 14 by any suitable means, such as a cap screw (not shown). Handle 16 is substantially perpendicular to piston rod 14 and has a length sufficient to allow space for both hands of the operator to grasp the handle 16 to manually operate the pump 10 with upstrokes (moving handle 16 away from the upper end of barrel 12) and downstrokes (pushing handle 16 toward the upper end of barrel 12).

Figure 2:
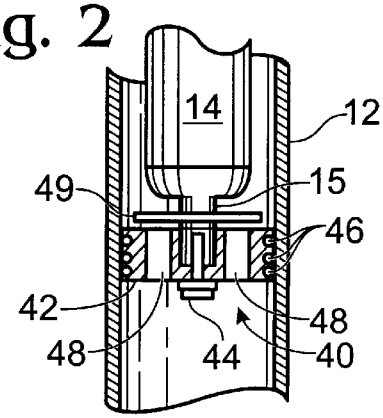
FIG. 2 is an enlarged, cross-sectional view of the piston subassembly of this invention.
Figure 3:
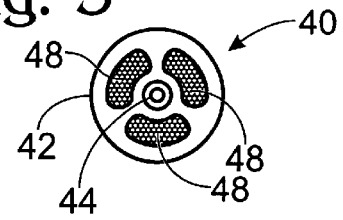
FIG. 3 is a top view of the pump piston.
Figure 4:
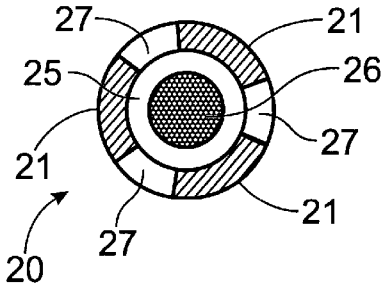
FIG. 4 is a bottom view of the inlet subassembly.
Figure 5:
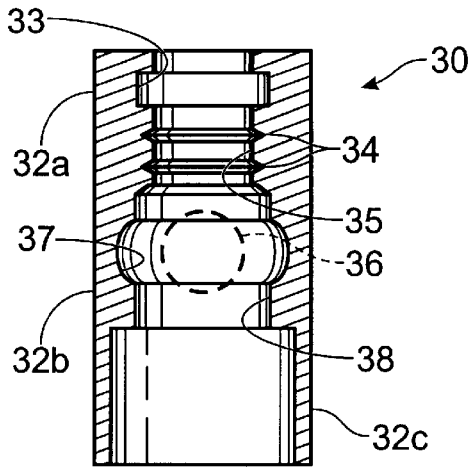
FIG. 5 is a cross-sectional view of the outlet subassembly.

A piston subassembly 40 is located on the tip 15 of piston rod 14, as best seen in FIG. 2. Piston subassembly 40 includes piston 42 which has planar upper and lower surfaces and a cylindrical wall extending between the upper and lower planar surfaces. The cylindrical wall of piston 42 is spaced from the inner wall of central passageway 13*a* a distance sufficient to allow for lubrication, as well known in the pumping art.

Piston 42 has a central opening therein into which outer end of tip 15 of piston rod 14 is inserted and attached to piston rod 14 by means of screw 44, as shown.

Piston 42 preferably has three annular centering/sealing grooves 46 located in the cylindrical wall thereof. Centering/sealing grooves 46 keep piston 42 centered within central passageway 13*a* and provides a sealing affect during the upstroke by virtue of the turbulence caused by the pumping action acting upon the fluid located within grooves 46. Grooves 46 also hold oil for lubricating the piston 42.

Preferably three equally spaced apart fluid passageways 48 pass through piston 42 and communicate that portion of the central passageway 13*a* of barrel 12 located below the lower planar surface of piston 42 with the that portion of the central passageway 13*b* of barrel 12 located above the upper planar surface of piston 42.

A flexible circular flapper valve 49 is located on the tip 15 of piston rod 14, spaced apart and above the upper planar surface of piston 42, as shown. The diameter of flapper valve 49 and its spacing from the upper planar surface of piston 42 is selected so that the flapper valve is brought into contact with the upper planar surface of piston 42 during an upstroke of piston rod 14 so that it substantially completely seals off passageways 48.

An oil filter 50 is attached to the outer end of nipple 39, such as by mating threads. Oil filter 50 is comprised of a cylindrical filter head 52 and a cylindrical filter container 54. Filter container 54 screws into filter head 52 for easy removal. Filter container 54 contains filtration material which operates to remove impurities from oil in a manner well known in the art. Oil filter 50 is preferably capable of capturing contaminants having a particle size down to about ten microns or less. There are a number of suitable commercially available filter units, and the construction of the filter unit, per se, forms no part of the present invention.

A threaded outlet fitting or nipple 59 is screwed into filter head 52 opposite nipple 39. A flexible discharge conduit or hose 60 is connected at its inner end to outlet nipple 59 of filter head 50. Discharge hose 60 is preferably fitted to a quick disconnect nozzle 62 via an inlet fitting 64 to enable attachment to the hydraulic oil receiving port of the machine or device being serviced; however other types of nozzles may be used. A plastic plug 66 is used to plug the outlet end of nozzle 62 when the apparatus is not in use.

Figure 6:
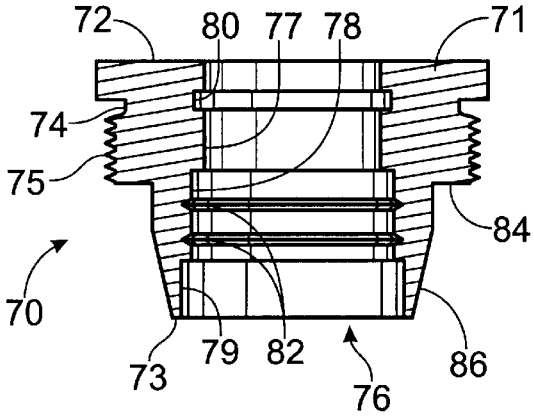
FIG. 6 is a cross-sectional view of the fluid supply container lock adapter.

Hydraulic oil typically is sold in five gallon containers (buckets) equipped with a threaded flexible pour spout. Another feature of this invention is in providing a supply container lock adapter 70, illustrated in FIGS. 6 and 7, which, after insertion of the lower portion of pump 10 into such a container, can be screwed onto the flexible pour spout of the container while the spout is retracted into the container to provide a rigid locking of the pump barrel 12 to the container.

Container lock adapter 70 has a tapered cylindrical body 71 having an upper end 72 and a lower end 73. An annular square sealing ring groove 74 is located adjacent the upper end. Threads 75 are located on the outside of body 71 adjacent the upper end 72 thereof.

A central passageway 76 extends through body 71 from the upper end 72 to the lower end 73 thereof. Central passageway 76 is comprised of an upper passageway defined by cylindrical wall 77, a central passageway defined by cylindrical wall 78, and a lower passageway defined by cylindrical wall 79. The diameter of the upper passageway is less than the diameter of the central passageway, and the diameter of the central passageway is less than the diameter of the lower passageway. The upper, middle, and lower passageways have a common longitudinal axis with each other and with barrel 12.

An annular O-ring groove 80 is located in cylindrical wall 77. Annular oil supply container spout threads 82 extend from cylindrical wall 78.

Figure 7:
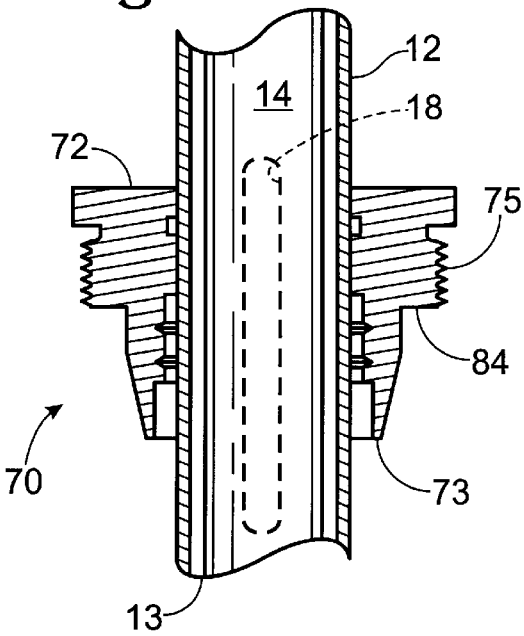
FIG. 7 is a view, partially in cross-section, of the fluid supply lock adapter located on the pump barrel.

Oil supply lock adapter 70 slides onto the outer cylindrical surface of barrel 12, as shown in FIG. 7, with the outer surface of barrel 12 engaging upper cylindrical wall 77 as shown. In the position shown, adapter 70 is adapted to engage the flexible pour spout of a typical five gallon bucket of hydraulic oil after barrel 12 has been inserted into the bucket and the bottom of inlet subassembly 20 has touched the bottom of the bucket. Adapter 70 is then screwed onto the flexible pour spout of the bucket while the spout is retracted into the bucket. Threads 82 of adapter 70 engage the threads of the flexible pour spout and pulls shoulder 84 down to the metal ring of the bucket lid. Tapered outer surface 86 of adapter 70 goes into the plastic outer area of the spout below the spout threads for more stability.

In the position of barrel 12 shown in FIG. 7 vent groove 18 is in line with adapter 70, adaptor 70 being shown in the position on barrel 12 it would occupy if attached to a five gallon supply bucket. Vent groove 18 has a length sufficient to permit the upper end thereof to communicate with the atmosphere when the lower end thereof is in communication with the inside of a supply container. In the relative position of adaptor 70 and vent groove 18 shown in FIG. 7, which occurs at the end of each downstroke and the beginning of each upstroke, air can enter the supply bucket through groove 18 thereby preventing a vacuum from forming inside the bucket as oil is pumped out, which might cause the bucket to collapse.

If it is desired to use pump 10 to remove hydraulic oil from a 30 gallon half drum or a 55 gallon barrel, barrel bung threads 75 located on the exterior of body 71 are adapted to matingly engage the threads of the bung opening of such half drums or barrels.

Although not shown in the drawings, a second longitudinally extending vent groove, similar to vent groove 18, can be located above vent groove 18 at a location to allow air to enter a 30 gallon half drum and/or a 55 gallon barrel.

In operation, the barrel 12 of pump 10 is inserted into an oil supply container. For purpose of discussion it will be assumed the oil container is a five gallon bucket having a flexible pour spout, such as one sold under the registered trademark "FlexSpout" by Rieke Corporation of Auburn, Ind. When barrel 12 touches the bottom of the bucket, adapter 70 is moved down barrel 12 into contact with the flexible pour spout while the spout is retracted into the bucket, and screwed thereon.

Oil is pumped out of its supply bucket by pump 10 by pumping piston rod 14 up and down by means of handle 16. The oil passes through filter 50 and is delivered to the machinery to which quick disconnect 62 is attached.

Pump 10 operates as follows. When handle 16 and attached piston rod 14 are moved upwardly (the "upstroke"), the oil trapped above the upper planar surface of piston 42 in the passageway 13 is pushed into cavity 37 and out through outlet nipple 39. At the same time, as piston 42 rises during its upstroke it creates a low pressure area (vacuum) below the lower planar surface of piston 42, which causes ball 26 to rise and allows oil to pass from first inlet passageway 23 into second inlet passageway 24, and from second inlet passageway 24 into the lower part of the central passageway of barrel 12 located below piston 42.

When handle 16 and attached piston rod 14 are moved downwardly (the "downstroke"), ball 26 is forced downward and is seated on shoulder 25, thereby closing communication between first and second inlet passageways 23 and 24. Thus, the oil below the lower planar surface of piston 42 is compressed and the force of the compressed oil pushing against the lower planar surface of piston 42 and into passageways 48 causes flapper 49 to rise. When flapper 49 rises it opens communication between the area below the lower planar surface of piston 42 and annular oil passageway 13, thereby causing oil to flow through fluid passages 48 in piston 42 into annular passageway 13 where it is forced into cavity 37 and out through outlet nipple 39.

Thus both the upward and downward stroke of piston rod 14 pumps oil from its supply container and through filter subassembly 50 and flexible hose 60 to its destination.

It can be seen from the foregoing description that pump 10 acts as a vacuum lift pump during the upstroke and as a displacement pump during the downstroke.

In order to provide for approximately the same amount of oil to be pumped during the upstroke and the downstroke (so that the pressure applied by the person doing the pumping is about the same during the upstroke and downstroke), it has been found that the ratio of the cross-sectional areas of the central passageway 13*a* of barrel 12 to piston rod 14 should be about 2:1, and the ratio of the cross-sectional areas of annular passageway 13*b* to piston rod 14 should be about 1:1.

Although the size of the pump and its various components can be varied in accordance with the ratios just discussed, and it is not intended to limit the invention to specific pump/component dimensions, it has been found desirable for many uses to size the pump and its components to deliver about 2 gallons per minute. This flow rate is achieved at a pumping rate of about 18 to 19 strokes per minute at about 14 ounces per combined up and down stroke where the area of piston rod 14 is about 0.441 inch, the area of bore 13*a* is about 0.833 inch, and the area of annular passageway 13*b* is about 0.392 inch.

All of the pumped oil passes through filter 54 which, preferably, is a no-bypass ten micron filter. However, other filters may be used, depending on the oil purity requirements of the machine to which the oil is being fed.

Although the discussion of the invention above has referred to hydraulic oil, it is clear that the invention could be used with any low viscosity fluid.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A hand operated pump and filter assembly for transferring low viscosity fluids from a supply container to a fluid receiving device comprising:

a pump having a barrel with inner and outer cylindrical walls, said barrel having a lower portion containing an inlet end and an upper portion containing an outlet end, at least said lower portion of said barrel adapted to be fully insertable into said supply container, said barrel having a central passageway formed by said inner cylindrical wall and extending from said inlet end to said outlet end, said barrel having at least one longitudinally extending vent groove located in the outer cylindrical wall thereof, said vent groove having a length adapted to allow said vent groove to communicate with the inside of said supply container and with the atmosphere outside said supply container when said lower portion of said barrel is fully inserted into said supply container;

a cylindrical piston rod having an inner end located within said central passageway of said barrel and an outer end located outside said central passageway of said barrel, said piston rod and said barrel having a common longitudinal axis, the outer surface of said piston rod being spaced apart from the inner wall of said barrel a distance sufficient to form an annular fluid passageway;

the outer end of said piston rod passing through a fluid seal at the outlet end of said barrel, said piston rod being attached at its outer end to a handle for effecting movement of said piston rod up and down along said longitudinal axis, including an upstroke of said piston rod during movement of said handle away from said barrel and a downstroke of said piston rod during movement of said handle toward said barrel;

the inner end of said piston rod being attached to a piston having upper and lower planar surfaces and a cylindrical wall extending between said upper and lower planar surfaces;

said piston having at least one fluid passageway extending therethrough between said upper and lower planar surfaces, said fluid passageway having associated piston valve means adapted to close communication through said fluid passageway of said piston during an upstroke of said piston rod and open communication through said fluid passageway of said piston during a downstroke of said piston rod, said open communication being solely between said central passageway of said barrel located below said lower planar surface of said piston and said annular fluid passageway located between the outer surface of said piston rod and the inner wall of said barrel;

an inlet valve means located adjacent said inlet end of said barrel, said inlet valve means being adapted to open communication between the exterior of said barrel and said central passageway during an upstroke of said piston rod and close communication during a downstroke of said piston rod;

a filter subassembly having an inlet and an outlet;

an outlet conduit communicating the outlet end of said barrel with said inlet of said filter subassembly; and a conduit communicating said outlet of said filter subassembly with said fluid receiving device.

2. The pump and filter assembly of claim 1 wherein said piston valve means is a flapper valve located above the upper planar surface of said piston.

3. The pump and filter assembly of claim 1 wherein said inlet valve means is an inlet subassembly having a first and second end, said subassembly being removably attached at its second end to the inlet end of said barrel, said first and second ends having first and second inlet passageways extending therethrough, said first inlet passageway communicating with the outside of said subassembly, said second inlet passageway communicating with the central passageway of said barrel, and a check valve located between said first and second passageways for opening communication therebetween during an upstroke of said piston rod and closing communication therebetween during a downstroke of said piston.

4. The pump and filter assembly of claim 3 wherein said inlet subassembly has at least one inlet groove at said first end, said inlet groove adapted to allow fluid from said supply container to flow therethrough into said first inlet passageway when said first end of said inlet subassembly is in contact with the bottom of said supply container.

5. The pump and filter assembly of claim 4 wherein said inlet groove is semi-circular in shape.

6. The pump and filter assembly of claim 4 wherein there are three inlet grooves.

7. The pump and filter assembly of claim 1 wherein said outlet end of said barrel has a generally cylindrical outlet subassembly body removably attached thereto, said outlet subassembly body having an upper body portion, a mid-body portion, and a lower body portion, said lower body portion having a cylindrical bore formed therein the wall of which is adapted to receive the outlet end of said barrel in tight engagement, said upper body portion having a cylindrical bore formed therein the wall of which is adapted to receive said piston rod in sliding engagement therewith, said upper body portion having an annular seal located in the wall of said upper body cylindrical bore, said annular seal being adapted to contact said piston rod in sealing engagement, the wall of the cylindrical bore of said upper body portion having a plurality of annular centering grooves located therein below said annular seal, said mid-body portion having a cavity formed therein adapted to receive fluid from said annular fluid passageway of said pump, the bores of said upper and lower body portions and the cavity of said mid-body portion having a common longitudinal axis with the longitudinal axis of said piston rod, and a fluid outlet passageway communicating said cavity with the exterior of said mid-body portion of said outlet subassembly body.

8. The pump and filter assembly of claim 1 wherein a liquid supply container lock adapter is slidably attached to the outer cylindrical surface of said barrel, said adapter being adapted to lockingly engage the outlet of said liquid supply container.

9. The pump and filter assembly of claim 8 wherein said lock adapter has threads located thereon adapted mate with threads on said outlet of said supply container.

10. The pump and filter assembly of claim 1 wherein said filter removes impurities in said fluid down to a particle size of about 10 microns.

11. The pump and filter assembly of claim 1 wherein the ratio of the cross-sectional area of said annular fluid passageway to the cross-sectional area of said piston rod is about 1:1.

12. The pump and filter assembly of claim 11 wherein the ratio of the cross-sectional area of said central passageway of said barrel to the cross-sectional area of said piston rod is about 2:1.

13. The pump and filter assembly of claim 1 wherein annular centering/sealing grooves are located in the cylindrical wall of said piston.

14. The pump and filter assembly of claim 13 wherein there are three annular centering/sealing grooves.

15. A hand operated pump for transferring low viscosity fluids from a supply container to a fluid receiving device comprising:

a barrel with inner and outer cylindrical walls, said barrel having a lower portion containing an inlet end and an upper portion containing an outlet end, at least said lower portion of said barrel adapted to be fully insertable into said supply container, said barrel having a central passageway formed by said inner cylindrical wall and extending from said inlet end to said outlet end, said barrel having at least one longitudinally extending vent groove located in the outer cylindrical wall thereof, said vent groove having a length adapted to allow said vent groove to communicate with the inside of said supply container and with the atmosphere outside said supply container when said lower portion of said barrel is fully inserted into said supply container;

a cylindrical piston rod having an inner end located within said central passageway of said barrel and an outer end located outside said central passageway of said barrel, said piston rod and said barrel having a common longitudinal axis, the outer surface of said piston rod being spaced apart from the inner wall of said barrel a distance sufficient to form an annular fluid passageway;

the outer end of said piston rod passing through a fluid seal at the outlet end of said barrel, said piston rod being attached at its outer end to a handle for effecting movement of said piston rod up and down along said longitudinal axis, including an upstroke of said piston rod during movement of said handle away from said barrel and a downstroke of said piston rod during movement of said handle toward said barrel;

the inner end of said piston rod being attached to a piston having upper and lower planar surfaces and a cylindrical wall extending between said upper and lower planar surfaces;

said piston having at least one fluid passageway extending therethrough between said upper and lower planar surfaces, said fluid passageway having associated piston valve means adapted to close communication through said fluid passageway of said piston during an upstroke of said piston rod and open communication through said fluid passageway of said piston during a downstroke of said piston rod, said open communication being solely between said central passageway of said barrel located below said lower planar surface of said piston and said annular fluid passageway located between the outer surface of said piston rod and the inner wall of said barrel;

an inlet valve means located adjacent said inlet end of said barrel, said inlet valve means being adapted to open communication between the exterior of said barrel and said central passageway during an upstroke of said piston rod and close communication during a downstroke of said piston rod; and an outlet passageway communicating the outlet end of said barrel with the exterior of said barrel.

16. The pump of claim 15 wherein said piston valve means is a flapper valve closely spaced apart from the upper planar surface of said piston.

17. The pump of claim 15 wherein said inlet valve means is an inlet subassembly having a first and second end, said subassembly being removably attached at its second end to the inlet end of said barrel, said first and second ends having first and second inlet passageways extending therethrough, said first inlet passageway communicating with the outside of said subassembly, said second inlet passageway communicating with the central passageway of said barrel, and a check valve located between said first and second passageways for opening communication therebetween during an upstroke of said piston rod and closing communication therebetween during a downstroke of said piston rod.

18. The pump and filter assembly of claim 17 wherein said inlet subassembly has at least one inlet groove at said first end, said inlet groove adapted to allow fluid from said supply container to flow therethrough into said first inlet passageway when said first end of said inlet subassembly is in contact with the bottom of said supply container.

19. The pump of claim 18 wherein said inlet groove is semi-circular in shape.

20. The pump of claim 19 wherein there are three inlet grooves.

21. The pump of claim 15 wherein said outlet end of said barrel has a generally cylindrical outlet subassembly body removably attached thereto, said outlet subassembly body having an upper body portion, a mid-body portion, and a lower body portion, said lower body portion having a cylindrical bore formed therein the wall of which is adapted to receive the outlet end of said barrel in tight engagement, said upper body portion having a cylindrical bore formed therein the wall of which is adapted to receive said piston rod in sliding engagement therewith, said upper body portion having an annular seal located in the wall of said upper body cylindrical bore, said annular seal being adapted to contact said piston rod in fluid sealing engagement, the wall of the cylindrical bore of said upper body portion having a plurality of annular centering grooves located therein below said annular seal, said mid-body portion having a cavity formed therein adapted to receive fluid from said annular fluid passageway of said pump, the bores of said upper and lower body portions and the cavity of said mid-body portion having a common longitudinal axis with the longitudinal axis of said piston rod, and a fluid outlet passageway communicating said cavity with the exterior of said mid-body portion of said outlet subassembly body.

22. The pump of claim 15 wherein a liquid supply container lock adapter is slidably attached to the outer cylindrical surface of said barrel, said adapter being adapted to lockingly engage the outlet of said liquid supply container.

23. The pump of claim 22 wherein said lock adapter has threads located thereon adapted to mate with threads on said outlet of said supply container.

24. The pump of claim 15 wherein the ratio of the cross-section area of said annular fluid passageway to the cross-sectional area of said piston rod is about 1:1.

25. The pump of claim 15 wherein the ratio of the cross-sectional area of said central passageway of said barrel to the cross-sectional area of said piston rod is about 2:1.

26. The pump of claim 15 wherein annular centering/sealing grooves are located in the cylindrical wall of said piston.

27. The pump of claim 26 wherein there are three annular centering/sealing grooves.

* * * * *